US006847331B2

(12) United States Patent
Joly et al.

(10) Patent No.: US 6,847,331 B2
(45) Date of Patent: Jan. 25, 2005

(54) DETACHABLE JACKETED ANTENNA WITH JACKET ROTATION PREVENTION FEATURE

(75) Inventors: Christian Joly, St. Denis (FR); Tobias Kleinert, Reutlingen (DE)

(73) Assignee: Hirshmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/310,957

(22) Filed: Dec. 6, 2002

(65) Prior Publication Data

US 2003/0156066 A1 Aug. 21, 2003

(30) Foreign Application Priority Data

Dec. 7, 2001 (DE) ..... 101 60 252

(51) Int. Cl.[7] ..... H01Q 1/32; H01Q 9/30

(52) U.S. Cl. ..... 343/713; 343/711; 343/900; 343/906

(58) Field of Search ..... 343/711, 900, 343/893, 906, 715, 713; H01Q 1/32, 9/30

(56) References Cited

U.S. PATENT DOCUMENTS 5,341,149 A 8/1994 Valimaa et al.

6,608,597 B1 * 8/2003 Hadzoglou et al. ..... 343/713

FOREIGN PATENT DOCUMENTS

| | | | | |
|---|---|---|---|---|
| DE | 100 08 063 A1 | | 8/2001 | ..... H01Q/1/24 |
| JP | 10-215111 | * | 8/1998 | ..... H01Q/1/12 |

* cited by examiner

*Primary Examiner*—Don Wong
*Assistant Examiner*—Trinh Vo Dinh
(74) *Attorney, Agent, or Firm*—Fulbright & Jaworski, L.L.P.

(57) ABSTRACT

A mobile antenna that repeatably can be attached and detached by rotation from motor vehicles. The antenna having a receiving portion electrically connected to a base body having a contact area for connecting to motor vehicles. The joined base body and receiving portion being encased in a jacket. The base body having grooves with flank surfaces also encased in the jacket; the grooves aligned in the lengthwise direction of the antenna so that the groove flank surfaces are essentially perpendicular to forces produced when the jacket is rotated for attachment and detachment of the antenna to or from the motor vehicle.

12 Claims, 3 Drawing Sheets

DETACHABLE JACKETED ANTENNA WITH JACKET ROTATION PREVENTION FEATURE

BACKGROUND OF THE INVENTION

1. Field of the Invention

The present invention relates to a jacketed antenna, and more particularly to a mobile telephone antenna for motor vehicles that can be attached and detached from motor vehicles by rotation of the antenna so that the jacket surrounding the antenna does not slip relative to encased interior antenna electrically conductive parts when the jacket is rotated for attachment and detachment of the antenna.

2. Description of the Related Technology

Antennas, especially mobile telephone antennas for motor vehicles, are known. These antennas often have a base body from which an electromagnetic wave receiving portion extends, such as an antenna coil or an antenna rod. Further such base bodies also are conductive and can be made of metal with a corresponding contact area for mating onto a motor vehicle by, for example, being threaded onto the motor vehicle body. Often a large portion of the base body, except for the contact area, and at least some part of the antenna receiving portion, are surrounded with an electrically nonconductive jacket to protect the covered metal parts from atmospheric caused corrosion and also to achieve an overall more pleasant appearance for the antenna structure. This jacket design for antennas makes it possible for the antenna conveniently to be removed from a motor vehicle, for example prior to having the motor vehicle moved through a car wash. It also is important, though, that when a detachable antenna is mounted on vehicle that there must be both good mechanical and electrical connections between the antenna and the vehicle to ensure structural stability and electrical transmission in order to provide effective antenna operation. In the case of antenna and vehicle screw connections via which an antenna is attached to a vehicle by a screw type connection, it is important that these screw type connections be maintained tight to prevent antennas from falling off of vehicles and from failing to maintain continuous electrical contact between the antenna and the motor vehicle. Antenna designs based on metal components being encased inside nonconductive jackets run the risk that such antennas will not be screwed tight to motor vehicle bodies because of the very real possibility of relative motion between the antenna metal inner components and the outside jackets which are all that can be gripped to rotate the antenna structure. Such rotary motion imported from a gripped jacket causes a force which acts on at least one flank of the antenna base body. This force acts on an oblique surface of the antenna base body (see FIG. 4A). Therefore, the prior art nonconductive jacket can slip around encased antenna conductive parts. This situation means that the prior art antenna may not be securely joined to the installation site. These insecure installation problems arise especially when the prior art antenna base body and the receiving portion have generally round exterior cross sections, which often are a design selection made for economic reasons to facilitate economical series production of antennas.

SUMMARY OF THE INVENTION

An object of this invention is to make available a jacketed antenna, especially a mobile telephone attachable/detachable antenna for motor vehicles, that provides for connection to motor vehicle bodies that is structurally stable over time and provides excellent electrical transmission to attached structures.

This object is achieved for antennas having surrounding pliable jackets, wherein antenna conductive parts inside the jackets do not slip relative to the jackets when the jackets are rotated to attach and detach the antenna to and from motor vehicles.

According to the invention, antennas have base bodies that are made such that when finished antennas are attached to installation sites, especially to the outside skin of motor vehicles, relative rotational motion between the antenna base bodies and surrounding jackets does not occur. Such relative rotary motion of the jacket, according to the invention, is prevented because of an almost right-angle structurally induced interaction of rotary force on at least one exterior flank surface of the base body. This almost right angle structurally induced interaction of rotary force and an exterior base body flank surface prevents relative motion between the base body and the rotated jacket. This prevention of relative rotary motion ensures that when handling the antenna by the jacket for attachment of the antenna to a motor vehicle a secure attachment can be achieved. For a screw connection the antenna can be tightened relatively securely by gripping and rotating the jacket.

When the antenna is dismounted from an installation site the prevention of relative rotary motion between the base body and the jacket has the advantage that the antenna can be reliably removed from its installation site. If relative rotary motion were to occur, the antenna might no longer be removable from its installation site, or could only be removed using a tool that could scar and damage the jacket. Such a tool might not even be available to a driver when for example, he intends to remove the antenna before driving through a car wash.

The base body and the antenna receiving portion can be two or more individual parts that are joined together. The base body also can be made in several parts. A single (integral) component which has the function of both also would be possible within the scope of this invention. Therefore, the base body also can be the antenna receiving portion, e.g., a base body having an extending antenna coil, which can be a spring, a connecting piece, a choke or the like.

Embodiments for the structure of the invention for preventing relative rotary motion between the base body and the jacket can include at least one crosspiece which is aligned in the lengthwise direction of the antenna and/or at least one groove which is aligned in the lengthwise direction of the antenna. At least one such groove easily can be made in the base body which may for example be manufactured as a turned part. If, for example, the base body is made as a casting or punched part, at least one crosspiece can be easily attached to the base body at the time of manufacture. It also is conceivable for the base body of the present invention to be provided with at least one hole into which a journal can be inserted. The base body can be provided equally well with slots into which blades which project beyond the exterior surface of the base body are inserted. Based on these embodiments with which the base body can be provided, relative motion between the base body and the jacket can be prevented after the jacket is attached. Incorporation of these embodiments with the base body have the advantage that the base body is located in the area of the thicker antenna base which is easier to grip for mounting and dismounting of the antenna than the middle area of the antenna or antenna rod.

In one alternative embodiment, the base body, at least in part, in its intermediate area, has a triangular or square cross section. Rotary motion of the jacket thus causes an almost right-angled action of rotary force on a groove or crosspiece surface incorporated with the exterior surface of the base body. As a result of incorporating these special exterior cross sections, relative motion between the base body and the jacket is likewise prevented. This is because for a hexagonal exterior cross section (i.e., an exterior surface with more corners) there is the danger that the encasing jacket will turn relative to the more multifaceted polygonal exterior cross section of a base body since the jacket is usually made of an elastic material, especially an elastic thermoplastic. In another alternative embodiment of the invention, an intermediate part is attached at an attachment site between the base body and the receiving portion to prevent relative motion between the base body and the jacket. If the base body and the receiving portion, especially if it is a spring, an antenna coil, a choke, a connecting piece, or an antenna rod are not made integral with the base body then there must be a connection to the base body provided. In such a case it is necessary for the base body to be provided with the receiving portion. This connection can take place, for example, by use of a solder connection, weld connection, conductive adhesive connection or material connection of some other type, or a force fit. In doing so, between the base body and an antenna receiving portion an intermediate part can be inserted and can be connected at the same time so that the base body is made such that relative rotary motion with an encasing jacket is prevented. The intermediate part can be, for example, a star-shaped component, and can also be a component with grooves or crosspieces that are aligned in the lengthwise direction of the antenna.

BRIEF DESCRIPTION OF THE DRAWINGS

One embodiment for an antenna and an antenna base body, which the invention however is not limited to and to which differences therefrom may occur to one skilled in the art without departing from the scope of the invention is described below and explained using the Figures, wherein.

DETAILED DESCRIPTION

Figure 1:
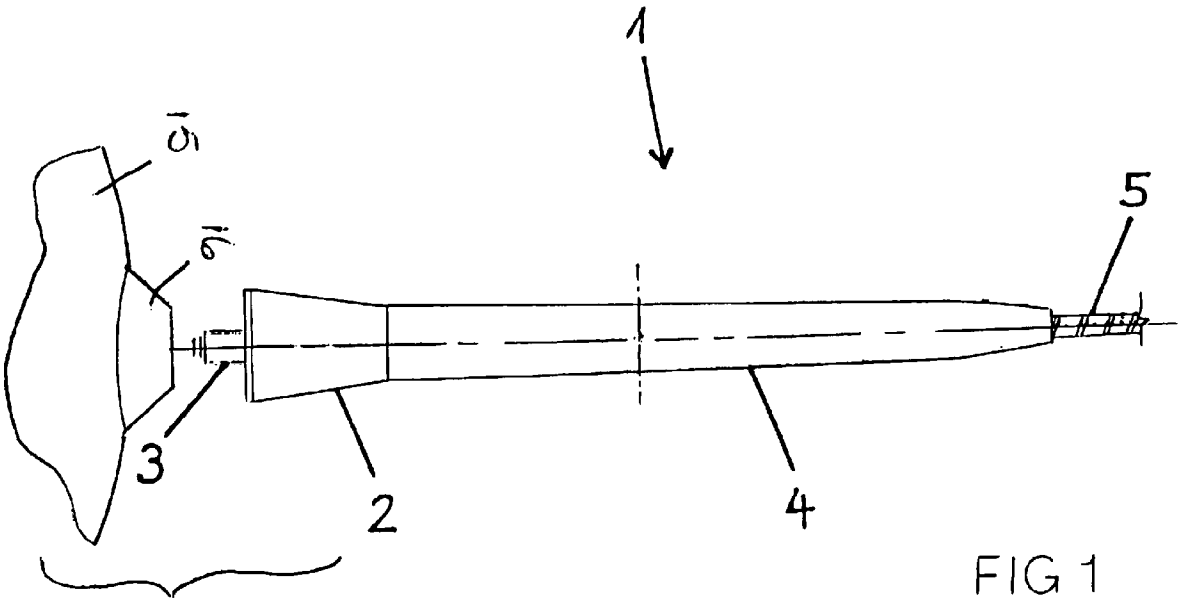
FIG. 1 is a motor vehicle antenna according to one embodiment of the invention in a partial exploded side view showing both the antenna and a partial section of the motor vehicle.

FIG. 1 shows an antenna 1, especially a radio antenna for motor vehicles, in a partial exploded side view. This antenna 1 has a conically shaped antenna base 2 which is provided with an electrically conductive contact area 3. Antenna 1 is constructed to be inserted into a motor vehicle body 15 (shown in partial section) via the contact area 3 which is made as a screw connection at an installation site 16. Extending in the lengthwise direction from the antenna base 2 is a middle area 4 of the antenna 1 and then an adjoining antenna rod 5. Antenna designs also are possible in which actual electromagnetic receiving portions do not extend to an antenna rod 5, but instead are located only in the middle area 4 (a so-called stub antenna). Such stub antenna designs are within the scope of the present invention.

Figure 2:
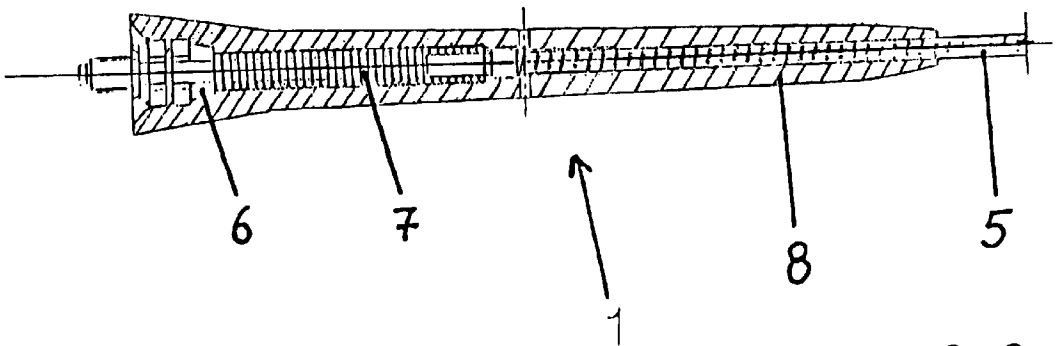
FIG. 2 is the a motor vehicle antenna as shown in FIG. 1 in cross section.

FIG. 2 shows the antenna 1 from FIG. 1 in a section view. In the area of the antenna base 2 an antenna base body 6 is shown with an attached antenna coil 7. The antenna base body 6 is electrically conductive and can be made of metal, but the base body 6 does not have to be made of metal as long as it provides for electrical conductivity from the antenna receiving portion to the motor vehicle body. Antenna coil 7 extends in the embodiment shown in the figures into roughly the center of the middle area 4 of the antenna 1 where the antenna coil 7 adjoins the antenna rod 5. FIG. 2 shows the base body 6, the antenna coil 7 and the lower part of the antenna rod 5 surrounded by jacket 8. This jacket 8 is nonconductive. Antenna 1 is designed to be flexible, and accordingly antenna coil 7 is made as a spring. Therefore, jacket 8 can be made of an elastically deformable material, especially a thermoplastic elastomer (TPE). The base body 6, the antenna coil 7 and the antenna rod 5, are connected to one another, for example by soldering or press fittings to provide an electrically conductive unitary structure. After these components are joined together, they are extrusion-coated with the jacket 8. It is also conceivable to insert the joined components into a mold and to produce the jacket 8 about the joined components by filling the mold.

Figure 3C:
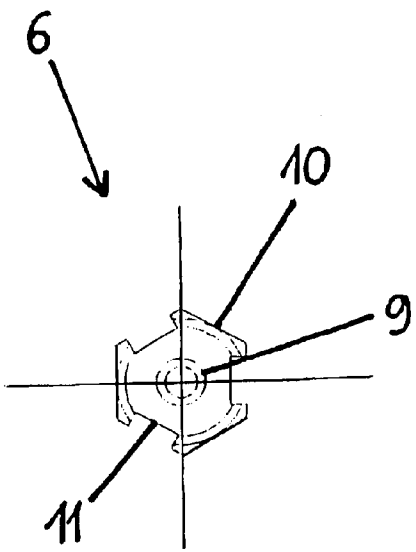
FIG. 3C is a top view of an antenna base body with grooves according to one embodiment of the invention.
Figure 3B:
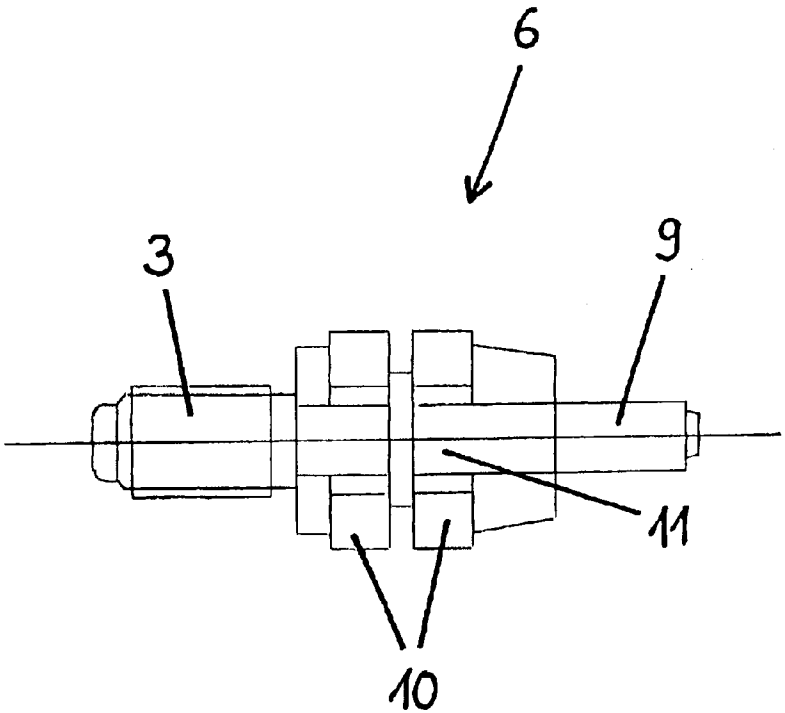
FIG. 3B is a side view of an antenna base body with groves according to one embodiment of the invention.
Figure 3A:
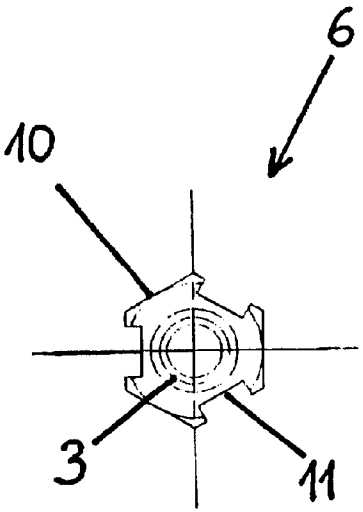
FIG. 3A is a bottom view of an antenna base body with groves according to one embodiment of the invention.

FIGS. 3A, 3B and 3C show the base body 6. In FIG. 3B the base body 6 is shown in a side view. On one end of the shown base body 6 is a contact area 3 (which can include an exterior screw thread), while the area facing away from the contact area 3 is made as a receiving area 9 for an electromagnetic receiving portion that can include the antenna coil 7. In this shown embodiment of the invention the receiving area 9 is made as a journal into which the spring-like antenna coil 7 can be pushed and attached. It also is possible to have for the receiving area 9 to be made as a blind hole into which an electromagnetic receiving portion can be inserted and attached. Between the contact area 3 and the receiving area 9 there is an intermediate area 10 that can have an hexagonal or lesser multi-faceted exterior shape to facilitate gripping for applying torque to base body 6. Other non-circular or irregular exterior surface shapes can be employed to provide a gripping surface such as triangular or square. Since as a result of the hexagonal exterior shape shown configuration of the intermediate area 10, it is not necessarily possible, especially when using a soft material for jacket 8, to prevent relative rotational motion between the base body 6 and the jacket 8 during screwing motion to tighten or loosen base body 6 onto or off of a motor vehicle. According to the embodiment of the invention shown in FIGS. 3A, 3B and 3C the base body 6 can have at least one groove 11 which is aligned in the lengthwise direction of the antenna 1. This at least one groove 11 provides an interface between jacket 8 and base body 6 so that the two structures are locked together and can no longer be rotated relative to one another when the a base body 6 is screwed onto or off of a motor vehicle body. As shown in FIGS. 3A and 3C several grooves 11 can be included to at least the intermediate area 10 and optionally beyond. Crosspieces, blades or the like, that extend out from base body 6 into the jacket 8 provide an alternative embodiment of the invention to grooves 11. A special advantage provided by grooves 11 is the fact that the material of jacket 8 extends into the grooves 11 and thereby does not reduce the thickness of the jacket 8 that is positioned about base body 6.

Figure 4A:
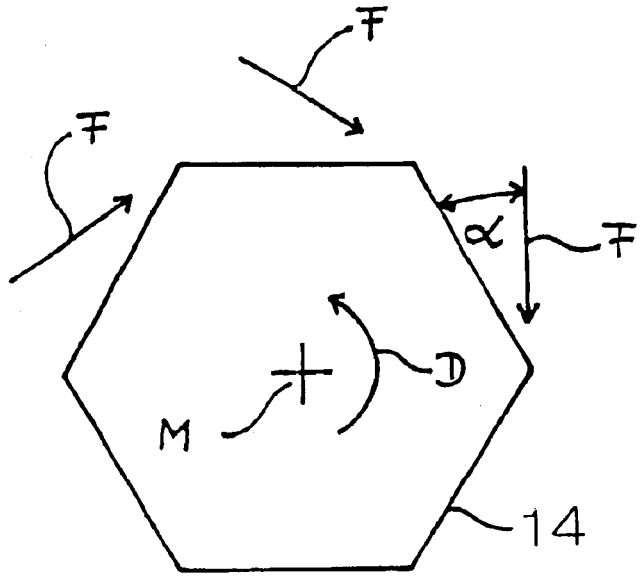
FIG 4A PRIOR ART
FIG. 4A is a bottom view force diagram of a prior art antenna base body.

FIG. 4A shows a bottom view force diagram of a prior art base body 14. Shown in FIG. 4A is how relative motion, or slipping, can occur between prior art base body 14 and surrounding material, such as a jacket 8. The bottom view force diagram set out in FIG. 4A shows rotary motion D around a middle axis M that causes a force F to act on the exterior of prior art base body 14. As shown the force F acts at an acute angle $\alpha$ against the hexangle flat exterior surfaces of the prior art base body 14. In that the acute angle $\alpha$ is less than 90 degrees (in fact less than 45 degrees) for the force F applied to the exterior surface of prior art base body 14, it is possible for any structure, such as a jacket 8, to slip around prior art base body 14 when acting to apply force F.

Figure 4B:
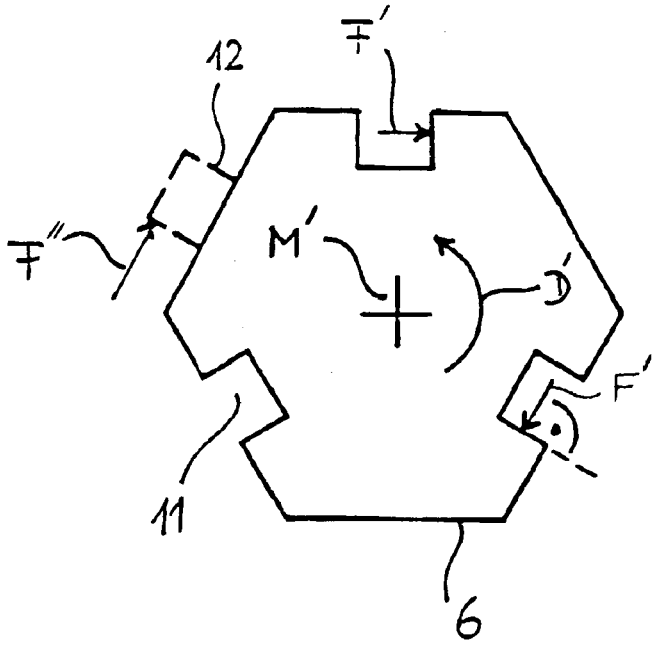
FIG. 4B is a bottom view force diagram of an antenna base body according to one embodiment of the invention.

FIG. 4B shows a bottom view force diagram for base body 6 with grooves 11 extending lengthwise along base body 6, i.e., into the paper. The bottom view force diagram set out in FIG. 4B shows rotary motion D around a middle axis M that causes a force F' to act on flank surfaces of grooves 11. As shown the force F' acts at an essentially perpendicular angle against flank surfaces of grooves 11. This essentially perpendicular action angle between force F' and flank surfaces of grooves 11 prevent relative motion between the base body 6 and whatever structure is used to provide force F' such as a jacket 8. Instead of grooves 11 (or also in addition thereto) there can also be at least one crosspiece 12 or several crosspieces 12, as is shown in phantom in FIG. 4B. Flank surfaces of crosspiece 12 provide surfaces against which forces F" can act in essentially the same perpendicular arrangements as for grooves 11. Flank surfaces of grooves 11 or of crosspiece 12 can also be aligned at an angle other than a right angle to the surface of the base body 6 as long as forces F' and F" act in essentially perpendicular fashion.

What is claimed is:

1. An antenna that by rotation of said antenna can be attached and detached from a structure, said antenna comprising:

a base body with a contact area disposed to be in electrical contact with said structure when said antenna is attached to said structure;

a receiving portion in electrical contact with said base body;

said base body and said receiving portion being encased in a jacket;

at least one flank surface provided on said base body and said flank surface being encased by said jacket; and a crosspiece disposed from said base body, said crosspiece having at least one flank surface and said crosspiece flank surface also being encased by said jacket, wherein a force produced when said jacket is rotated in one direction acts in an essentially perpendicular arrangement from said jacket against at least one of said flank surfaces and when said jacket is rotated in an opposite direction another force acts in an essentially perpendicular arrangement from said jacket against at least one other of said flank surfaces.

2. The antenna according to claim 1, wherein said structure is a motor vehicle body.

3. The antenna according to claim 1, wherein a groove is disposed into said base body and a surface of said groove is a flank surface provided on said base body.

4. The antenna according to claim 1, wherein a groove is disposed into said base body and at least one surface of said groove is a flank surface, and a crosspiece is disposed from said base body and at least one surface of said crosspiece is a flank surface.

5. The antenna according to claim 1, wherein said receiving portion includes an antenna rod.

6. The antenna according to claim 1, wherein said receiving portion includes an antenna coil.

7. The antenna according to claim 1, wherein said receiving portion includes an antenna rod and an antenna coil.

8. An antenna that by rotation of said antenna can be attached and detached from a structure, said antenna comprising:

a base body with a contact area disposed to be in electrical contact with said structure when said antenna is attached to said structure;

a receiving portion in electrical contact with said base body;

said base body and said receiving portion being encased in a jacket; and a crosspiece disposed from said base body, said crosspiece having at least two flank surfaces and said flank surfaces also being encased by said jacket, wherein a force produced when said jacket is rotated in one direction acts in an essentially perpendicular arrangement from said jacket against at least one of said flank surfaces and when said jacket is rotated in an opposite direction another force acts in an essentially perpendicular arrangement from said jacket against at least one other of said flank surfaces.

9. The antenna according to claim 8, wherein said structure is a motor vehicle body.

10. The antenna according to claim 8, wherein said receiving portion includes an antenna rod.

11. The antenna according to claim 8, wherein said receiving portion includes an antenna coil.

12. The antenna according to claim 8, wherein said receiving portion includes an antenna rod and an antenna coil.

* * * * *